US005535791A

United States Patent [19]

Lisec

[11] Patent Number: 5,535,791

[45] Date of Patent: Jul. 16, 1996

[54] CONTAINER FOR FREE-FLOWING MASSES AND PROCESS FOR FILLING AND EMPTYING THESE CONTAINERS

[76] Inventor: Peter Lisec, Bahnhofstrasse 34, A-3363 Amstetten-Hausmening, Austria

[21] Appl. No.: 258,063

[22] Filed: Jun. 10, 1994

[30] Foreign Application Priority Data

| | | | |
|---|---|---|---|
| Nov. 10, 1993 | [AT] | Austria | 2280/93 |
| Nov. 19, 1993 | [AT] | Austria | 2348/93 |
| Nov. 29, 1993 | [AT] | Austria | 2412/93 |
| Dec. 1, 1993 | [AT] | Austria | 2436/93 |
| Mar. 14, 1994 | [EP] | European Pat. Off. | 94890058 |
| Mar. 21, 1994 | [AT] | Austria | 587/94 |

[51] Int. Cl.[6] ..... B65B 1/00

[52] U.S. Cl. ..... 141/113; 141/45; 141/59; 141/114; 141/316; 141/307; 406/13; 406/109

[58] Field of Search ..... 141/10, 21, 44, 141/45, 59, 53, 67, 68, 113, 114, 307, 313–317, 370, 371, 2, 7, 18, 65, 390, 391; 406/13, 21, 34, 36, 109, 122, 151–154, 168, 175; 222/95, 105, 160, 162, 181, 185

[56] References Cited

U.S. PATENT DOCUMENTS

| | | | |
|---|---|---|---|
| 554,458 | 2/1896 | Rebsamen | 141/307 X |
| 2,643,807 | 6/1953 | Gialanella | 141/45 |
| 2,858,051 | 10/1958 | Cunningham | 222/103 |
| 3,323,559 | 6/1967 | Sturges | 141/10 |
| 3,372,725 | 3/1968 | Voorhees | 222/105 X |
| 3,955,853 | 5/1976 | Rusterholz | 406/109 X |
| 4,165,024 | 8/1979 | Oswalt et al. | 222/105 |
| 4,167,235 | 9/1979 | Green | 222/105 |
| 4,224,367 | 9/1980 | Scholle | 383/113 X |
| 4,492,294 | 1/1985 | Ball | 406/36 X |
| 4,527,716 | 7/1985 | Haas et al. | 222/83.5 |
| 4,541,765 | 9/1985 | Moore | 414/267 |
| 4,896,706 | 1/1990 | Tanner et al. | 141/114 |
| 4,966,310 | 10/1990 | Hawkins | 222/105 |
| 5,163,587 | 11/1992 | Apps et al. | 22/105 |
| 5,176,187 | 1/1993 | Grant | 141/10 |

FOREIGN PATENT DOCUMENTS

| | | |
|---|---|---|
| 538510 | 2/1981 | Austria . |
| 1038808 | 9/1978 | Canada . |
| 0232567 | 8/1987 | European Pat. Off. . |
| 76149989 | 9/1976 | Germany . |
| 3151701 | 7/1983 | Germany . |
| 85285617 | 1/1986 | Germany . |
| 3936761 | 11/1990 | Germany . |
| 4232318 | 10/1993 | Germany . |
| 93133650 | 12/1993 | Germany . |
| 972188 | 10/1964 | United Kingdom . |
| WO86/02910 | 5/1986 | WIPO . |
| WO93/06027 | 4/1993 | WIPO . |

*Primary Examiner*—J. Casimer Jacyna
*Attorney, Agent, or Firm*—Young & Thompson

[57] ABSTRACT

A container (1) for masses (17) which can be pumped and which flow freely consists of a sack-shaped bag (3) made of flexible, diffusion-impervious plastic sheet which is closed pressure tight and arranged in a holding frame (2). From a bottom area (9) of bag (3), a conduit (11) to which an intake conduit (13) can be coupled emerges from the bag's discharge opening (10), which can also serve as a filling hole. During removal of mass (17) from the bag (3), the latter is progressively raised by a hoist (16). In this way and under the action of the reduced pressure prevailing inside the bag (3), the latter assumes an increasingly slimmer pear shape. In this way, the mass (17) accumulates in the area of the mouth of the conduit (11), and the mass (17) can be completely removed from the bag without difficulty and without air inclusions. In order to laterally support and protect the bag (3) when it is full, a holding frame (2) has a wall (5). The bottom (4) of the holding frame (2) has a cavity (20) in its middle, from the lowest point of which the conduit (11) emerges. Via a valve (14) provided in the bag (3) at the top, air can be pumped out of the bag (3) while the latter is being filled with the mass (17) or while the mass (17) is being removed.

41 Claims, 5 Drawing Sheets

CONTAINER FOR FREE-FLOWING MASSES AND PROCESS FOR FILLING AND EMPTYING THESE CONTAINERS

Free-flowing and pasty-viscous masses, in particular Thiokol-based plastics such as those used to seal insulating glass panes, are generally packed by the manufacturer in barrels or drums for transport to the manufacturer of the insulating glass panes. To remove the mass from the barrels, so-called barrel pumps are used which have a pressure plate which is placed against the surface of the mass contained in the barrel, which is held inside the barrel, and which removes the mass from the barrel at the top. In particular when there is only a very small mass in the barrel, removal becomes difficult, and a larger or smaller amount of the mass which can no longer be removed is left in the barrel. Another drawback is that transport of the empty barrels back to the manufacturer of the mass is costly, since the empty barrels, although weighing little, take up considerable space.

AU-PS 538 510 describes a container for holding free-flowing or pasty masses which is a single-ply bag made of flexible plastic. The bag is placed in a frame-type rack formed like a pallet underneath and filled with the material to be transported and stored, the upper end of the container via which it has been filled being fastened to a rigid part of the upper end of the rack. For removal, a discharge line which is connected to a discharge opening of the container which lies underneath is attached at the bottom of the rack. In order to be able to remove as much of the material as possible, it is suggested in AU-PS 538 510 that the bottom surface of the rack which holds the container be shaped at an angle so that the mass flows to the discharge opening.

The drawback to this configuration is that, with viscous-pasty masses in particular, the after flow of the mass to the discharge opening is not sufficient if the mass is being removed relatively quickly.

A similar configuration is known from U.S. Pat. No. 4,165,024, in which the upper end of a flexible bag which is held in a frametype rack is attached to an upper transverse beam of the rack. A discharge line through which the mass can be removed is joined to the bottom end of the container. Yet another configuration is known from U.S. Pat. No. 4,165,024 in which a pump which sucks the material out of the container is connected to the discharge line. The disadvantages specified for the container according to AU-PS 538 510 apply even more so to the container according to U.S. Pat. No. 4,165,024, since the bottom is shaped completely flat, and the mouth of the discharge opening projects upward into the container so that an unremovable remainder of the mass is left in the container.

It has also been known that bags which hold a comparatively easily flowing mass are raised during removal of the mass, while the mass in the bag is simultaneously squeezed downward by two axially parallel rollers which move downward along the bag and which are placed against the bag from the outside. The drawbacks to this procedure are the expense for the rollers and the fact that the mass again cannot be entirely removed.

The problem of the invention is to devise a container of the sort initially mentioned which does not have the described drawbacks and from which the entire mass can be removed.

With the container according to the invention, masses which can be pumped or which flow freely, even if they are viscous-pasty, thus, for example Thiokol-based plastics, can be easily transported to the consumer, and as needed they can be removed by the latter from the container. After complete removal of the mass from the container, the latter can be transported back to the manufacturer of the mass again while saving space.

According to one embodiment of the invention it is provided that the line leading to the negative pressure device is connected to the vent opening with the interposition of a vessel with a cross section enlarged relative to the diameter of the vent opening and to the diameter of the line leading to the negative pressure device.

Because the negative pressure is applied to the vent opening of the bag via the intermediate vessel there is almost no danger of mass from the bag entering the line which leads to the negative pressure line unobserved. Because the interposed vessel has a large cross section, in it the flow rate of the mass emerging through the vent opening is small so that enough time is available to take measures to prevent mass entering the negative pressure line.

The invention also relates to a process for removal of free-flowing masses such as pasty-viscous masses, and especially Thiokol-based plastics such as those used to seal insulating glass panes.

Because a pressure which is reduced compared to the ambient pressure develops in the bag as the mass is progressively removed from the bag, for example, using a suction pump, the bag gradually collapses. Since the container is progressively raised little by little during removal of the mass, for example, by a hoist which engages a fitting in the area of the discharge opening, the bag becomes gradually slimmer, assuming roughly a pear shape. In this way, the mass contained in the bag always accumulates in the area of the discharge opening located in the middle of the bag on the lower end, so that the mass can be completely removed. Another advantage is that there is no danger of air being trapped in the removed mass.

If, according to one suggestion of the invention, the fill hole remains closed during removal of mass from the container, air is prevented from entering the container while the mass is being removed. This is a particular advantage for masses sensitive to air and humidity.

Finally, the invention relates to a process for pouring a viscous-pasty mass into a container made of a flexible material through a fill hole located on the bottom end of the container in the position in which it is used.

The processes according to the invention ensure that the space available in the container is or is being completely filled with the mass and that no air inclusions or other air pockets are formed or remain which could be detrimental to the mass, impair removal and reduce the available volume of the bag.

Other details and features of the invention derive from the following description of examples of embodiments of a container according to the invention:

Figure 1:
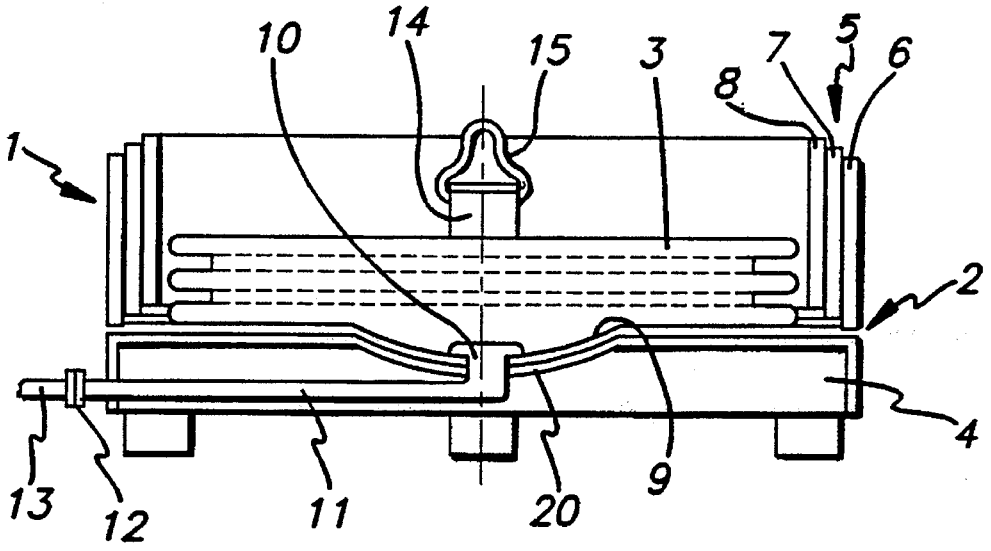
FIG. 1 shows an empty container consisting of a bag and a holding frame for it.
Figure 2:
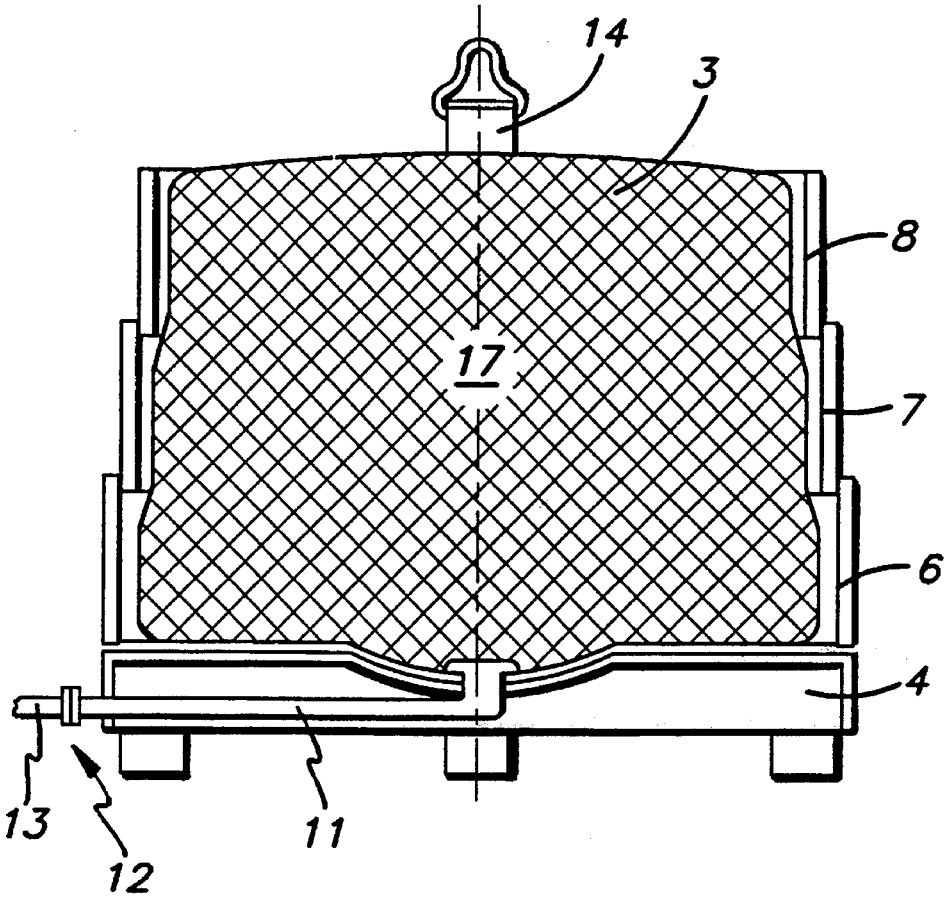
FIG. 2 shows a container filled with viscous-pasty mass.
Figure 3:
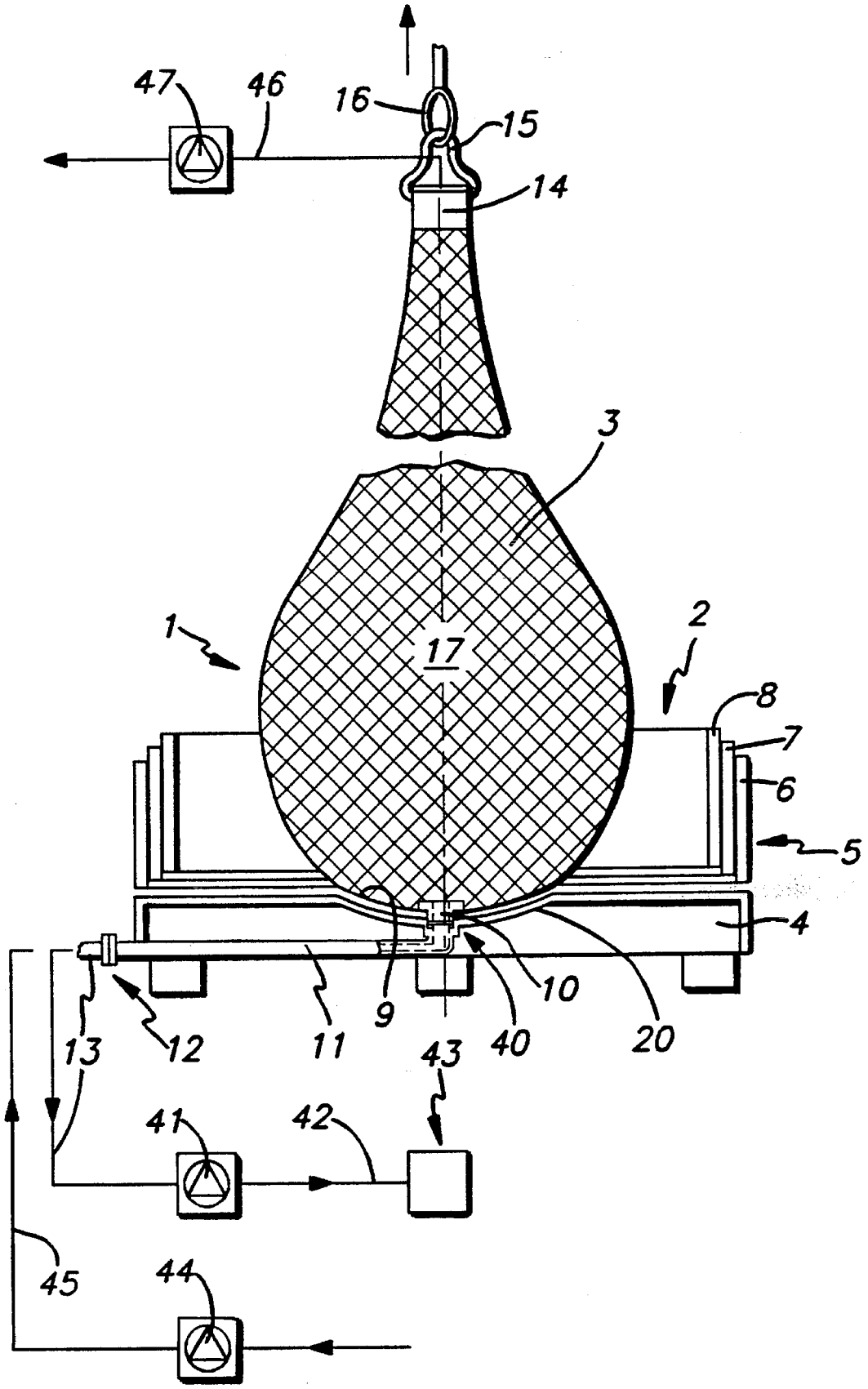
FIG. 3 shows the partially emptied container with assigned system parts.

Container 1 according to the invention consists of holding frame 2 and bag 3 in the embodiment shown in FIGS. 1 through 3.

Holding frame 2 consists of bottom plate 4 in the shape of a pallet and lateral support wall 5 which projects upward from the bottom plate and which in the embodiment shown is composed of three wall parts 6, 7 and 8 which can telescope into and out of one another. Wall parts 6, 7 and 8 can have a rectangular or square plan form. But they can also preferably be made round.

In bottom area 9 of bag 3 there is opening 10 from which line 11 emerges which runs to the lateral edge of bottom plate 4, and there has a (quick-fitting) union 12 via which another line 13 can be connected. The inside end of line 11 which reaches upward into bag 3 is tightly attached to bottom area 9 of bag 3 by screwed connection 40 (compare FIG. 3). Through line 13 mass 17 removed from container 1 is delivered (pumped) by feed pump 41 through line 42 to consumer 43, for example, to nozzle 43 of an automatic sealing machine.

Mass 17 is poured into bag 3 of container 1 according to the invention likewise via line 11 and opening 10.

As a modification of the embodiment shown, there can also be both a fill hole and a discharge opening in bottom area 9 of bag 3. Accordingly, there are then two lines 11 which run to the edge of holding frame 2 and which are equipped with unions 12.

At the upper end of bag 3 there is valve 14 designed as a non-return valve which allows only gas (air) to leave the interior of bag 3 while preventing gas (air) from entering bag 3. In the area of valve 14, another fitting, for example, ring 15, is attached to which hoist 16 can be connected (see FIG. 3) in order to raise bag 3.

If container 1, that is, bag 3 itself, is to be filled with mass 17, the mass is pumped by pump 44 through line 45 and through line 11, and via opening 10, therefore from underneath, into bag 3, so that the bag gradually assumes the shape shown in FIG. 2. Wall 5, either by the unfolding of bag 3, or assisted by hoists which are not shown, or by hand, assumes the telescopically extended position shown in FIG. 2. It goes without saying that means which are not shown are provided which limit the relative shifting of wall parts 6, 7 or 7, 8, if the latter have assumed the extended position shown in FIG. 2.

Air contained in bag 3 flows out through valve 14 when bag 3 is being filled. This can be assisted by connecting negative pressure line 46 which runs to suction pump 47 to valve 14 at the upper end of bag 3. Thus, any air which happens to be in bag 3 flows out or is sucked out so that bag 3 is ultimately filled to the top with mass 17 and contains no more air. The air can be pumped out of bag 3 before the latter is filled with mass 17. However, often air will be pumped out via the vent opening equipped with valve 14, while bag 3 is filled from the bottom up with mass 17.

Bag 3 consists, for example, of diffusion-impervious plastic material which can be reinforced with fabric or fibers. The plastic which comprises bag 3 can be rendered diffusion-impervious, for example, by vacuum metallizing (metal coating), preferably on the inside of bag 3. For many masses it is especially important that they do not come into contact with air and/or humidity, because they then for example begin to harden or their properties change in undesirable ways. It is therefore important for these masses that diffusion of air and water vapor into bag 3 is prevented so that mass 17 does not come into contact with these media.

In bottom plate 4 of holding frame 2 for bag 3 there is a trough-like cavity 20 with opening 10 of bag 3 at its lowest point. Thus it is ensured in conjunction with the fact that mass 17 is being pumped out of container 1 through line 11 that mass 17 can be almost entirely removed from bag 3. Pumping out mass 17 through line 11, together with raising bag 3, causes bag 3 to gradually become slimmer and slimmer as the mass is removed under the effect of the air pressure acting on it from the outside. This advantageous effect can be assisted by applying negative pressure to the upper area of bag 3.

Filled container 1, shown in FIG. 2, is transported to a consumer. There, line 13 is connected to it using quick-fitting union 12, and container 1 is ready for removal of mass 17.

As has been mentioned, and as FIG. 3 shows, as mass 17 is being removed, bag 3 can be gradually raised by hoist 16 so that as mass 17 is removed, the bag will assume the aforementioned increasingly slimmer pear shape.

The removal of mass 17 from bag 3 can, as mentioned, be assisted by applying negative pressure to line 11, for example, via line 13 connected by (quick-fitting) union 12, thus pumping out mass 17.

It goes without saying that at the start of removal, even when bag 3 is being lifted, the bag will be lying with its lower area still against wall 5, as before. Only towards the end of the removal process (FIG. 3) will bag 3 no longer be supported by wall 5, but held by hoist 16. It stands with its bottom area 9 in the area of cavity 20 on bottom plate 4.

Because a pressure which is reduced compared to the ambient pressure is formed in bag 3 as mass 17 is progressively removed from it, for example, using a suction pump, bag 3 gradually collapses. When, during removal of mass 17, bag 3 is progressively raised little by little by hoist 16 which engages fitting 15 located in the area of opening 14, bag 3 assumes an increasingly slimmer, rough pear shape. In this way, mass 17 contained in bag 3 always accumulates in the area of discharge opening 10 located in the middle of bag 3 on the bottom end so that mass 17 can be completely removed. Another advantage is that there is no danger of air being trapped in the removed mass. If need be, air accumulating in the upper area of bag 3 can also be sucked out via the vent opening with valve 14 while mass 17 is being removed.

When mass 17 has been completely removed from bag 3, the latter is folded up and laid inside the area circumscribed by wall parts 6, 7, 8 which have been telescoped back together, so that it can again be transported back to the manufacturer of free-flowing mass 17 in protected form, without requiring a large amount of transport volume. Folding up bag 3 is made simple, since bag 3 is completely empty after removal of mass 17, therefore it contains no air which would make the bag difficult to fold back up.

Figure 5:
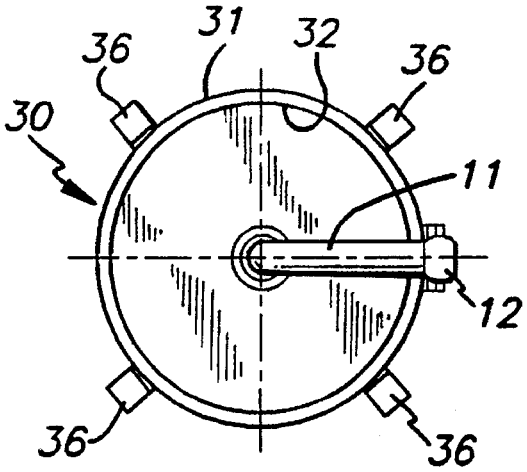
FIGS. 4 through 6 show a stackable embodiment of one holding frame.
Figure 6:
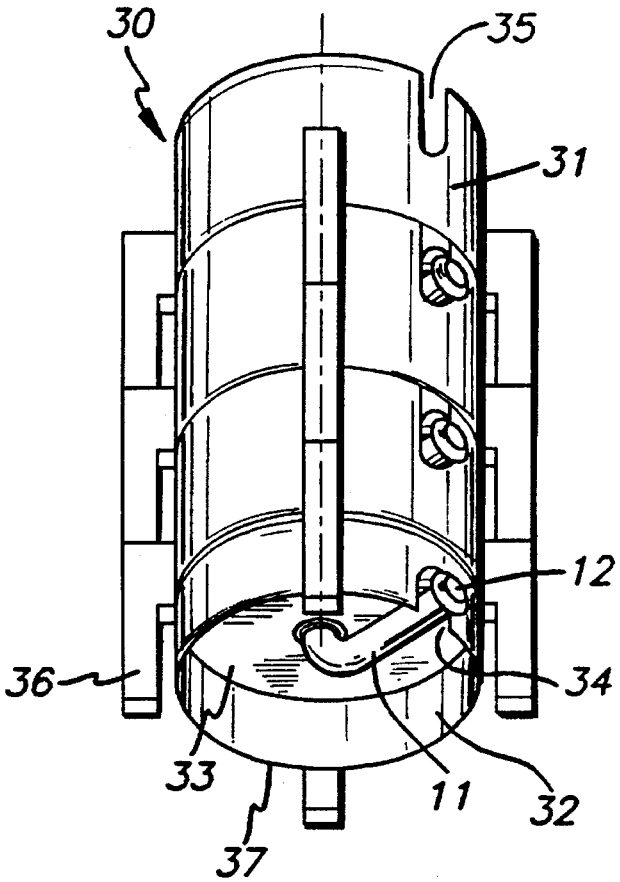
Figure 4:
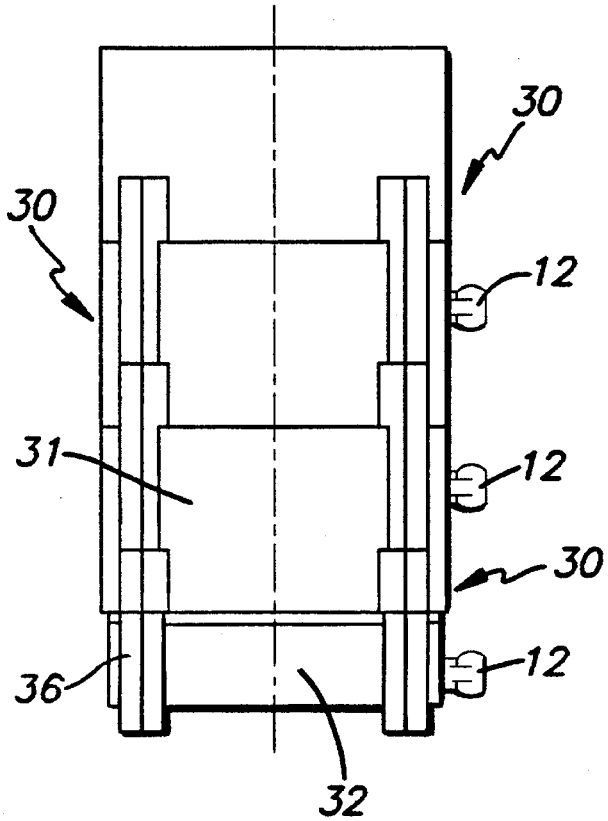

FIGS. 4 through 6 show a embodiment of a holding frame 30 for bag 3.

In the embodiment of holding frame 30 shown in FIGS. 4 through 6, the lateral support wall 31 for bag 3 filled with mass 17 is shaped like a circular cylinder jacket. Wall 37 can also have another, for example polygonal, plan form. At the bottom edge of wall 31 there is a bottom plate 33 which is preferably made to slope down from the edge, that is, from wall 31 down to the middle. Line 11 which can be connected or is connected to opening 10 of bag 3 proceeds from the middle, that is, from the lowest area of bottom plate 33 of holding frame 30.

A skirt 32 projects downward from bottom plate 33; this skirt has, for example, a likewise round plan form which corresponds to support wall 31. The free end of line 11 with the part of (quick-fitting) union 12 which is attached to it projects outward through a recess 34 in skirt 32.

The outside diameter of skirt 32 is such that it can be slid into the space circumscribed by wall 31 when holding frames 30 with empty bags 3 are stacked on top of one another, as shown in FIGS. 4 and 6. In order that stacking not be obstructed by the part of line 11 which juts out, in wall 31 there is a recess 35 which is open to the top and which is located exactly above the outer end of line 11.

In the embodiment shown, on the outside of wall 31 four feet 36 are attached which project above bottom edge 37 of skirt 32.

It is evident from FIG. 4 that the bottom ends of feet 36 are far enough from the outer surface of skirt 32 that wall 31 of another holding frame 30 can be slid between skirt 32 and feet 36 when holding frames 30 are stacked.

It can also be arranged during removal of mass 17 from bag 3 via line 13 connected to quick-fitting union 12 that just enough mass 17 can be sucked out of bag 3 through line 11 to completely fill at least one tank, which is supplied with mass 17 via line 13 (and via pump 41 provided in it). After this amount of mass 17 has been removed from bag 3 and the tank has been completely filled, sucking of mass 17 out of bag 3 is stopped and is only resumed when the tank has been emptied completely or up to a (pre)defined amount. A corresponding procedure can also be used if several tanks and/or at least one metering pump are being supplied with mass 17 removed from container 1 or its bag 3.

Thus, in the invention it is preferable to proceed such that mass 17 is removed intermittently from container 3.

As described above, the removal of mass 17 from bag 3 of container 1 is assisted by bag 3 being raised upwards by hoist 16 connected to fitting 15 of bag 3. Bag 3 is raised advantageously in this way not exactly at the beginning of the removal process, that is, when bag 3 is completely filled (see FIG. 2), but rather only after a given or preselectable fraction of mass 17 has been removed from bag 3. This can be accomplished easily by applying to bag 3 via hoist 16 an upwardly directed force which therefore lifts bag 3, the magnitude of this force corresponding to a fraction of the weight of completely filled bag 3. By means of this comparatively simple measure bag 3 is raised gradually without special control of the pulling force—it is sufficient that the force be set to a certain amount and kept constant—and the removal of mass 17 from container 3, as explained above, is improved.

In a preferred embodiment, line 11 in the area where part of it points upwards is screwed to bottom area 9 of bag 3. Line 11 is connected by means which are not shown to bottom plate 4 of holding frame 1, or in the embodiment shown in FIGS. 4, 5 and 6, to bottom plate 33 of holding frame 30.

Figure 7:
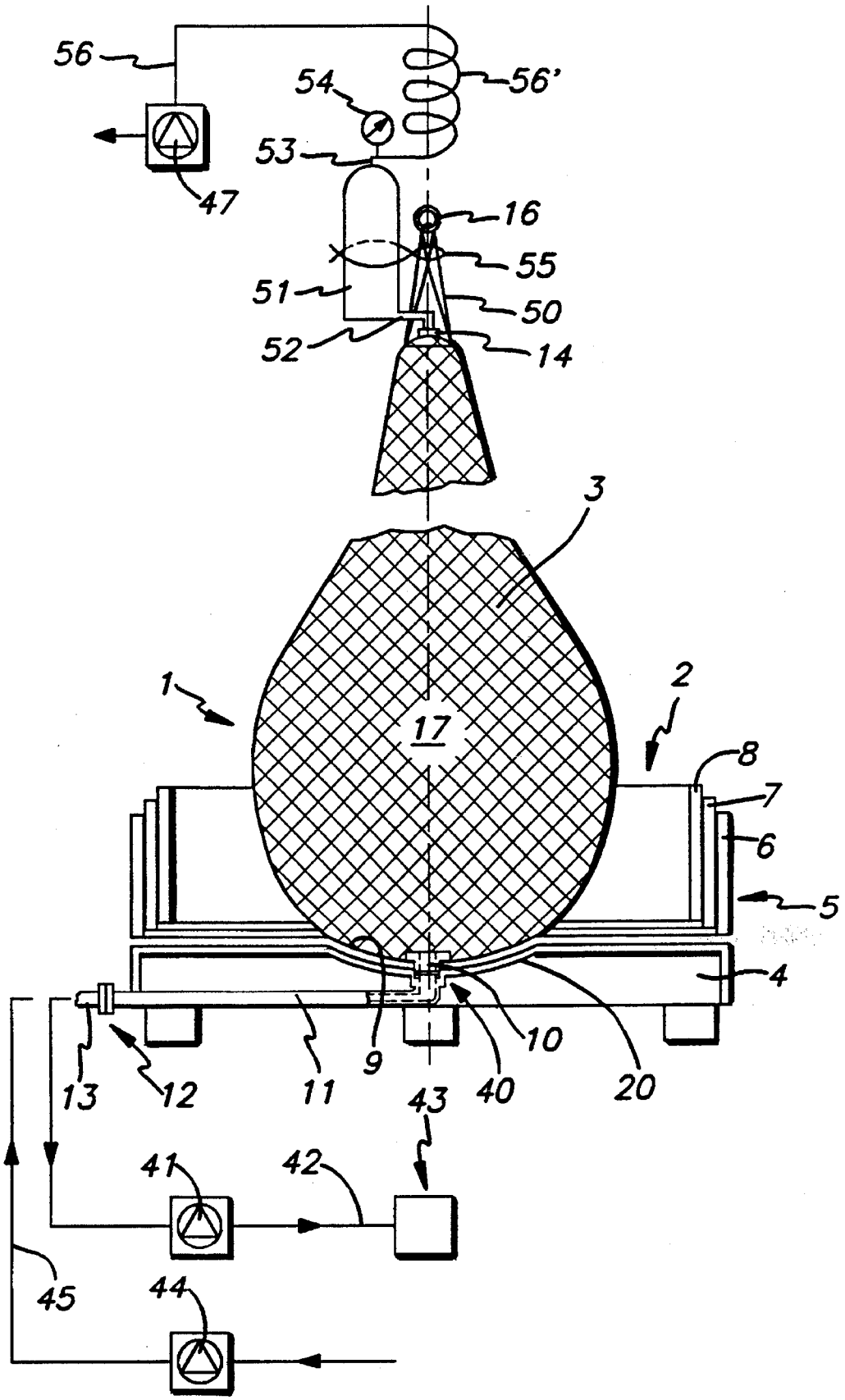
FIG. 7 shows a partially emptied container with assigned system parts.

As shown in FIG. 7, vent opening 14 provided on the top end of bag 3 can be connected via connecting line 52 to intermediate vessel 51. Intermediate vessel 51 consists, for example, of transparent plastic. From the top end of intermediate vessel 51 a connecting piece 53 emerges on which there can be manometer 54 from which line 56 proceeds. In the embodiment shown, line 56 is formed at least in the area of its section 56' connected to intermediate vessel 51 as a screw spiral which is placed around the lifting cable of hoist 16. To keep intermediate vessel 51 secure, there is a somewhat figure eight-shaped clamp 55 with ring placed around loops 50 on the top end of bag 3, intermediate vessel 51 being held in the second open ring of clamp 55.

In the arrangement of intermediate vessel 51 it can be easily ascertained by visual observation whether mass 17 from bag 3 enters the interior of intermediate vessel 51 through vent opening 14 under the action of the negative pressure applied from negative pressure device 47 via line 56 and whether suitable measures are taken before mass 17 enters line 56, 56'. Because the interior of intermediate vessel 51 is enlarged relative to the cross section of vent opening 14 and that of line 56, enough time remains to take measures (for example, shut-off of negative pressure device 47) before mass 17 enters line 56, 56', since the flow rate of mass 17 in the area of intermediate vessel 51 is slow.

Figure 8:
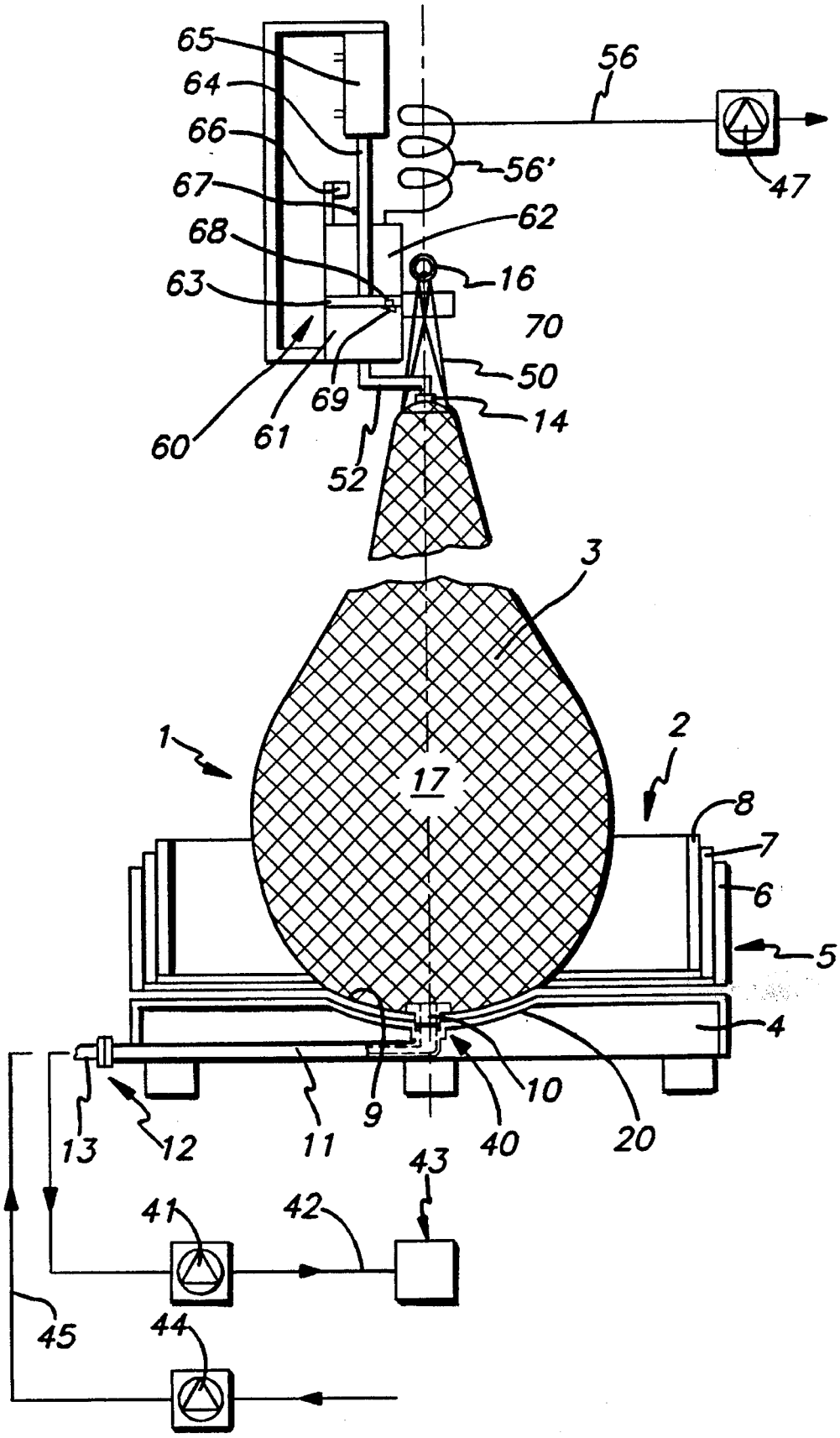
FIG. 8 shows a different embodiment.

In the embodiment shown in FIG. 8 intermediate vessel 60 is likewise connected via line 52 to vent opening 14 of bag 3. Space 61 of intermediate vessel 60 to which line 52 is connected is of variable size and is bounded to the top by piston 63 which can be moved in intermediate vessel 60. Line 56, 56' leading to negative pressure device 47 is connected to the top end of intermediate vessel 60 and acts via through hole 68 in piston 63 also in space 61 of intermediate vessel 60.

If in the version shown in FIG. 8, mass 17 from bag 3 enters space 61 of intermediate vessel 60 via vent opening 14 and line 52 and fills intermediate vessel 60 to the extent that it reaches piston 63, the latter is pushed upward until control cam 67 on piston rod 64 of hydraulic motor 65 actuates switch 66 assigned to piston rod 64. As soon as this occurs, hydraulic motor 65 is actuated and pushes piston 63 back down. In doing this, flap valve 69 assigned to through hole 68 in piston 63 under the action of mass 17 in space 61 is pressed into its closed position, compression spring 70 which for the time being keeps open flap valve 69 being compressed. In this way, when piston 63 is pushed down under the action of hydraulic cylinder 65 mass 17 is prevented from entering upper space 62 of intermediate vessel 60. As soon as mass 17 from space 61 of intermediate vessel 60 has been displaced back into bag 3 under the action of piston 63 moving downward, piston 63 is likewise raised again by hydraulic motor 65 and the device is ready for re-use. Flap valve 69 provided in piston 63 can also be opened and closed by a drive (not shown). Any other type of shut-off device can likewise be assigned to piston 63, including, for example, magnetically actuated shut-off devices.

Figure 9:
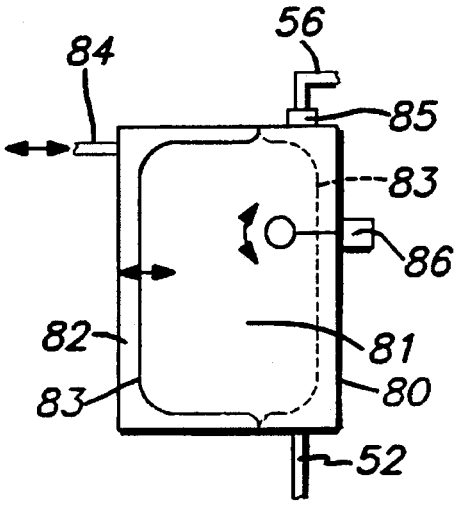
FIG. 9 shows another embodiment of an intermediate vessel.

The intermediate vessel can also be formed as shown in FIG. 9. In this embodiment, space 81 of intermediate vessel 80 is of variable size since it is bounded on one side by flexible wall 83 (membrane). Space 82 in intermediate vessel 80 can be pressurized via connection 84 by introducing a pressure medium (compressed air, hydraulic fluid). If space 81 is filled with mass 17 from bag 3 to such an extent that there is the danger that mass 17 enters line 56, shut-off device 85 (for example, a solenoid valve, flap valve or the like) is closed and pressure medium is forced via connection 84 into space 82 so that flexible wall 83 is moved from its original position shown in FIG. 6 into the position shown by the broken line in FIG. 6 and in doing so mass 17 contained in space 81 is pressed back into bag 3. As soon as this has taken place, wall 83 is moved back into its initial position, for example, by applying negative pressure to space 82.

These working steps can be initiated by observation of space 81 by an operator or by sensor 86 which responds to the presence of mass 17 (photoelectric barrier, or float-light sensor).

With the arrangement of intermediate vessel 51 or 60 according to the invention, negative pressure can be applied to vent opening 14 of bag 3; as described above this is advantageous for the discharge process, since collection of gas or air in the upper area of bag 3 is prevented and folding up of bag 3 is supported in an advantageous manner. In doing so there is no danger that mass 17 can reach line 56', 56 which leads to negative pressure device 47.

In summary, the invention can, for example, be represented as follows:

A container 1 for mass 17 which can be pumped and which flows freely consists of sack-shaped bag 3 which is made of flexible, diffusion-impervious plastic sheet which is closed pressure tight and which is set up in holding frame 2. From bottom area 9 of bag 3 line 11 to which an intake line 13 can be joined emerges from the bag's discharge opening 10 which can also simultaneously be the fill hole. During removal of mass 17 from bag 3, the bag is progressively raised by hoist 16. In this way and under the action of the reduced pressure prevailing inside bag 3, bag 3 assumes a gradually slimmer, pear shape. In this way mass 17 accumulates in the area of the mouth of line 11, and mass 17 can be completely removed from bag 3 easily and without air inclusions. In order to laterally support and protect bag 3 when it is full, holding frame 2 has a wall 5. Bottom 4 of holding frame 2 has a cavity in the middle, from the lowest part of which line 11 emerges. Via valve 14 provided at the top in bag 3, air can be pumped out of bag 3, while the latter is filled with mass 17 and/or while mass 17 is removed.

Line 56, 56' which leads to negative pressure source 47 is connected to vent opening 14 provided at the top in flexible bag 3 via intermediate vessel 51 with enlarged cross section. Since intermediate vessel 51 has a cross section enlarged relative to the cross section of vent opening 14, the interior of intermediate vessel 51 fills up only slowly with mass 17 possibly emerging through vent opening 14 from bag 3. This prevents mass 17 from directly entering line 56 leading to negative pressure device 47 and moreover there is enough time to take suitable measures which prevent entry of mass 17 into line 56.

What is claimed is:

1. Container (1) for flowable masses (7), comprising a bag (3) made of flexible material, an opening (10) for mass (17) at the bottom of the bag (3), a holding frame (2, 30 ) for the bag (3 ) with a bottom plate (4, 33) and with a wall (5, 6, 7, 8, 31) which laterally supports the filled bag (3), a connection device (15) for a hoist (16) at the top of the bag (3), means for filling the bag through said opening (10), said opening (10) comprising a single opening (10) that serves both as a fill hole and as a discharge opening, from which a conduit (11) emerges, there being a vent opening at the upper end of bag (3), a conduit (46) which leads to a negative pressure device (47) connected to the vent opening, the vent opening having a valve (14) which is a nonreturn valve and opens only in a direction from the inside of said bag (3) to the outer side of said bag (3).

2. Container according to claim 1, wherein said means comprises a conduit which runs into an edge area of the bottom plate (4, 33) and is connected to said opening (10).

3. Container according to claim 2, wherein said conduit (11) emerging from said opening is connected to said opening by a screwed connection (40).

4. Container according to claim 2, wherein said conduit (11) emerging from said opening is attached to said bottom plate (44, 33) of said holding frame (2, 30).

5. Container according to claim 1, wherein a conduit (11) for removal of the mass runs into an edge area of the bottom plate (4, 33) and is connected to said opening (10).

6. Container according to claim 1, wherein the bag (3) is composed of a material impervious to the diffusion of water vapor.

7. Container according to claim 6, wherein the bag (3) is diffusion-impermeable by virtue of a metal coating.

8. Container according to claim 7, wherein the metal coating is on the inside of the bag (3).

9. Container according to claim 1, wherein a conduit (13) supplies to a pump (41) which delivers mass (17) the last named conduit (13) being connected to a conduit (11) emerging from said opening (10).

10. Container according to claim 9, wherein a second pump (44) delivers mass (17) to said bag (3) and can be connected to said conduit (11) which emerges from said opening (10).

11. Container according to claim 10, and quick-coupling means (12) for connecting either of said pumps (41, 44) to said conduit (11) emerging from said opening (10).

12. Container according to claim 1, wherein said vent connection for said negative pressure device is effected using a quick-fitting union.

13. Container according to claim 1, wherein said conduit (56) leading to said a negative pressure device (47) is connected to said vent opening (14) with the interposition of one vessel (51, 60, 80) with a cross section enlarged relative to the diameter of said vent opening (14) and relative to the diameter of said conduit (56) which leads to said negative pressure device (47).

14. Container according to claim 13, wherein the wall of said one vessel (51, 60, 80) consists at least partially of transparent material.

15. Container according to claim 13, wherein said one vessel (51, 60, 80) is vertically elongated and is connected with its bottom end to said vent opening (14), and wherein said conduit (56) leading to said negative pressure device (47) proceeds from the top end of said one vessel (51, 60).

16. Container according to claim 13, wherein said one vessel (51, 60, 80) is detachably attached by a connection device (50) via which said top end of said bag (3) can be connected to said hoist (16).

17. Container according to claim 16, wherein a roughly figure eight-shaped clamp (55) made of resilient material is provided for attachment of said one vessel (51).

18. Container according to claim 13, wherein in said one vessel (60) space (61, 81) connected to said vent opening (14) of said bag (3) is bounded on one side by a wall (63, 83) which is adjustable.

19. Container according to claim 18, wherein the last named wall is a piston (63) which can be moved in said one vessel.

20. Container according to claim 19, wherein said piston (63) is connected to a hydraulic cylinder (65).

21. Container according to claim 20, wherein said piston (63) is connected to a piston rod (64) of said hydraulic cylinder (65),and wherein a switch (66) is actuated by a control cam (67) attached to said piston rod (64).

22. Container according to claim 19, wherein in said piston (63) there is at least one through hole (68) which can be closed by a valve (69).

23. Container according to claim 22, wherein said valve (69) is a flap valve.

24. Container according to claim 23, wherein said valve (69) is pressed by a spring (70) into a position which clears said through hole (68).

25. Container according to claim 19, wherein said line (56) leading to said negative pressure device (47) on the housing of said one vessel (60) is connected on the side of said piston (63) opposite the connection side of said vent opening (14) of said bag (3).

26. Container according to claim 18, wherein said adjustable wall (83) is flexible.

27. Container according to claim 26, wherein said wall (83) is fastened with its edges on the housing of said one vessel (80).

28. Container according to claim 26, wherein a space (82) in said one vessel (80) which lies on the side of said wall (83) facing away from a space (81) for said mass (17) in said one vessel (80) can be loaded with a pressure medium and wherein a shut-off device (85) is disposed in said line (56).

29. Container according to claim 26, wherein a sensor (86) which responds to the presence of said mass (17) is located a space (81) in said one vessel (80) in which said mass (17) accumulates.

30. Container according to claim 1, wherein said wall (31) is rigid.

31. Container according to claim 30, wherein said wall (31) is circular in a horizontal projection.

32. Container according to claim 1, wherein said wall (5) of said holding frame (2) consists of at least two parts (6, 7, 8) which can be telescoped into and out of one another.

33. Container according to claim 32, wherein said telescoping parts (6, 7, 8) are circular.

34. Container according to claim 32, wherein said telescoping parts (6, 7, 8) each have a height which corresponds to the height of said bag (3) when said bag is collapsed and empty.

35. Container according to claim 1, wherein there is a cavity (20) in said bottom plate (4, 33) of said holding frame (2, 30) in the area of said opening (10) of said bag (3) and wherein a conduit (11) emerges from the lowest point of said cavity (20).

36. Container according to claim 1, wherein said wall (5, 31) is connected to said bottom plate (4, 33).

37. Container according to claim 1, wherein said bottom plate (4) is a pallet.

38. Container according to claim 1, wherein said wall (31) is integral with said bottom plate (33).

39. Container according to claim 1, wherein said bottom plate (33) is connected to said wall (31) above a bottom end of said wall (31).

40. Container according to claim 1, wherein on the outside of said wall (31) there are at least three feet (36) which project above a bottom edge (32) of said wall (31).

41. Container according to claim 40 wherein said feet (36) are at a distance from said wall (31) at the bottom (32) of said wall (31).

* * * * *